US012733782B2

(12) United States Patent
Kang et al.

(10) Patent No.: US 12,733,782 B2
(45) Date of Patent: Sep. 15, 2026

(54) VACUUM CLEANER AND METHOD FOR CONTROLLING THE SAME

(71) Applicant: SAMSUNG ELECTRONICS CO., LTD., Suwon-si (KR)

(72) Inventors: Hyunkoo Kang, Suwon-si (KR); Juhyuk Kim, Suwon-si (KR); Sanghwa Choi, Suwon-si (KR); Seehyun Kim, Suwon-si (KR); Sanghyuk Park, Suwon-si (KR); Jinwook Yoon, Suwon-si (KR); Dongseok Lee, Suwon-si (KR); Seongu Lee, Suwon-si (KR); Jeonghee Cho, Suwon-si (KR); Seungryong Cha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 44 days.

(21) Appl. No.: 18/122,280

(22) Filed: Mar. 16, 2023

(65) Prior Publication Data

US 2023/0363601 A1 Nov. 16, 2023

Related U.S. Application Data

(63) Continuation of application No. PCT/KR2023/003163, filed on Mar. 8, 2023.

(30) Foreign Application Priority Data

May 16, 2022 (KR) ..... 10-2022-0059807
Dec. 20, 2022 (KR) ..... 10-2022-0179727

(51) Int. Cl.

| | |
|---|---|
| ***A47L 9/28*** | (2006.01) |
| ***A47L 5/30*** | (2006.01) |
| ***A47L 9/04*** | (2006.01) |

(52) U.S. Cl.
CPC ..... *A47L 9/2821* (2013.01); *A47L 5/30* (2013.01); *A47L 9/0411* (2013.01);
(Continued)

(58) Field of Classification Search
CPC ..... A47L 9/2821; A47L 5/30; A47L 9/0411; A47L 9/0477; A47L 9/2826; A47L 9/2831; A47L 9/2842; A47L 9/2847; A47L 5/26
See application file for complete search history.

(56) References Cited

U.S. PATENT DOCUMENTS 4,733,431 A * 3/1988 Martin ..... A47L 9/1472 96/418
5,255,409 A * 10/1993 Fujiwara ..... A47L 9/2831 15/412
(Continued)

FOREIGN PATENT DOCUMENTS

CN 1891132 A 1/2007
GB 2572433 B 11/2020
(Continued)

OTHER PUBLICATIONS

FR 2590471 (Year: 1987).*
(Continued)

*Primary Examiner* — Alexander Markoff
(74) *Attorney, Agent, or Firm* — STAAS & HALSEY LLP

(57) ABSTRACT

A vacuum cleaner including a main body; a suction head including a suction port through which debris is sucked up; a brush configured to rotate in the suction head; a brush motor configured to rotate the brush; a suction motor configured to generate suction force so that debris is sucked up through the suction port; a pressure sensor configured to measure atmospheric pressure and pressure at the suction
(Continued)

port; and at least one processor configured to determine suction pressure based on the measured atmospheric pressure and the measured pressure at the suction port, and determine cleaner state information, including at least one of operation state information and information of a type of surface to be cleaned, based on the determined suction pressure and a load of the brush motor.

12 Claims, 15 Drawing Sheets

(52) U.S. Cl.
CPC ..... *A47L 9/0477* (2013.01); *A47L 9/2826* (2013.01); *A47L 9/2831* (2013.01); *A47L 9/2842* (2013.01); *A47L 9/2847* (2013.01)

(56) References Cited

U.S. PATENT DOCUMENTS

| | | | | |
|---|---|---|---|---|
| 5,722,109 | A * | 3/1998 | Delmas | A47L 9/2894 15/412 |
| 5,881,430 | A * | 3/1999 | Driessen | A47L 9/2847 15/319 |
| 9,763,551 | B2 | 9/2017 | Murchie et al. | |
| 10,178,933 | B2 | 1/2019 | Lee et al. | |
| 12,440,078 | B2 * | 10/2025 | Kim | A47L 5/26 |
| 12,564,301 | B2 * | 3/2026 | Choi | A46B 13/02 |
| 2006/0085095 | A1 * | 4/2006 | Reindle | A47L 9/2842 700/258 |
| 2008/0034532 | A1 | 2/2008 | Yang | |
| 2013/0201316 | A1 * | 8/2013 | Binder | H04L 67/12 701/2 |
| 2019/0387942 | A1 | 12/2019 | Truitt et al. | |
| 2020/0219507 | A1 * | 7/2020 | Jun | G06N 3/006 |
| 2021/0007569 | A1 | 1/2021 | Howard et al. | |
| 2021/0186291 | A1 * | 6/2021 | Nguyen | A47L 9/325 |
| 2021/0251451 | A1 | 8/2021 | Ko et al. | |
| 2023/0329499 | A1 * | 10/2023 | Lee | A47L 9/2826 |
| 2023/0363301 | P1 * | 11/2023 | Arts | A01H 6/7499 |
| 2024/0032755 | A1 * | 2/2024 | Choi | A46B 13/02 |
| 2025/0134331 | A1 * | 5/2025 | Cho | A47L 9/2831 |

FOREIGN PATENT DOCUMENTS

| | | | |
|---|---|---|---|
| JP | 7-59697 | A | 3/1995 |
| JP | 2008-220812 | A | 9/2008 |
| JP | 2015-130956 | A | 7/2015 |
| KR | 10-2015-0126046 | A | 11/2015 |
| KR | 10-2016-0075450 | | 6/2016 |
| KR | 10-2021-0105207 | | 8/2021 |
| WO | WO 2018/202367 | A1 | 11/2018 |
| WO | WO 2022/008871 | A1 | 1/2022 |
| WO | WO 2022/008873 | A2 | 1/2022 |

OTHER PUBLICATIONS

International Search Report dated Jun. 29, 2023 for International Application No. PCT/KR2023/003163.

Extended European Search Report dated Apr. 1, 2025 for European Application No. 23807753.1.

* cited by examiner

FIG. 9

| CLEANER STATE INFORMATION | DESCRIPTION OF CONTROL |
|---|---|
| Lift(CLEANING IS NOT PERFORMED) | MINIMIZE OUTPUT |
| Hard floor | REFERENCE OUTPUT |
| Carpet | CONTROL TO PRODUCE MORE THAN REFERENCE OUTPUT |
| Mat | CONTROL TO PRODUCE LESS THAN REFERENCE OUTPUT |

VACUUM CLEANER AND METHOD FOR CONTROLLING THE SAME

CROSS-REFERENCE TO RELATED APPLICATIONS

This application is a continuation application of international Application No. PCT/KR2023/003163, filed on Mar. 8, 2023, which claims priority to Korean Patent Application No. 10-2022-0059807, filed on May 16, 2022 and Korean Patent Application No. 10-2022-0179727, filed on Dec. 20, 2022, the disclosures of which are incorporated by reference herein in their entireties.

BACKGROUND

1. Field

The disclosure relates to a vacuum cleaner having a suction head equipped with a rotational brush, and a method for controlling the vacuum cleaner.

2. Description of the Related Art

In general, a vacuum cleaner includes a suction motor for generating suction force, a suction head for sucking up air and debris on a surface to be cleaned with the suction force of the suction motor, and a debris collection chamber for separating and collecting the debris from the air sucked up through the suction head to perform cleaning.

The suction head may include a housing having a suction port and a brush for swiping the surface to be cleaned to lead the debris to be efficiently sucked up through the suction port. The brush may be rotationally provided by being connected to a brush motor.

SUMMARY

Aspects of embodiments of the disclosure will be set forth in part in the description which follows and, in part, will be apparent from the description, or may be learned by practice of the presented embodiments.

According to an embodiment of the disclosure, a vacuum cleaner may include a main body; a suction head including a suction port through which debris is sucked up; a brush configured to rotate in the suction head; a brush motor configured to rotate the brush; a suction motor configured to generate suction force so that debris is sucked up through the suction port; a pressure sensor configured to measure atmospheric pressure and pressure at the suction port; and at least one processor configured to determine suction pressure based on the measured atmospheric pressure and the measured pressure at the suction port, and determine cleaner state information, including at least one of operation state information and information of a type of surface to be cleaned, based on the determined suction pressure and a load of the brush motor.

According to an embodiment of the disclosure, the pressure sensor includes a relative pressure sensor including a first pressure sensor configured to measure the atmospheric pressure, and a second pressure sensor configured to measure the pressure at the suction port, and the relative pressure sensor is configured to output a difference between the atmospheric pressure measured by the first pressure sensor and the pressure at the suction port measured by the second pressure sensor.

According to an embodiment of the disclosure, the pressure sensor includes an absolute pressure sensor configured to measure the pressure at the suction port, and the at least one processor is configured to determine the atmospheric pressure based on an output of the pressure sensor before operation of the suction motor, and determine the pressure at the suction port based on an output of the pressure sensor during operation of the suction motor.

According to an embodiment of the disclosure, the vacuum cleaner further includes a current sensor configured to measure a current to the brush motor, and the at least one processor is configured to determine the load of the brush motor based on the current to the brush motor.

According to an embodiment of the disclosure, the vacuum cleaner further includes a voltage sensor configured to measure a voltage of a battery which supplies power to the brush motor, and the at least one processor is configured to determine the load of the brush motor in proportion to consumption power of the brush motor.

According to an embodiment of the disclosure, the at least one processor is configured to use correlation information between previously determined suction pressures, previously determined loads of the brush motor, and previous cleaner states determined based on the previously determined loads of the brush motor and the previously determined suction pressures according to the previously determined cleaner states to determine the cleaner state information corresponding to a current suction pressure and a current load of the brush motor.

According to an embodiment of the disclosure, the at least one processor is configured to use a hyperplane determined by a support vector machine (SVM) having the previously determined suction pressures according to the previously determined cleaner states and the previously determined loads of the brush motor as training data to determine the cleaner state information.

According to an embodiment of the disclosure, the hyperplane is a boundary plane separating respective different cleaner states differentiated by different suction pressures and different loads of the brush motor.

According to an embodiment of the disclosure, the hyperplane is a linear kernel.

According to an embodiment of the disclosure, the hyperplane is a hyperplane having a maximum separation distance from the training data in a space with the previously determined suction pressures and the previously determined loads of the brush motor as attributes.

According to an embodiment of the disclosure, the at least one processor is configured to determine a transition of cleaner state based on the hyperplane to update the cleaner state information.

According to an embodiment of the disclosure, the at least one processor is configured to, when a region, among a plurality of regions separated by the hyperplane, to which the determined suction pressure and the load of the brush motor belong is changed a preset number of times or more, determine the cleaner state information based on the previously determined cleaner state corresponding to the changed region.

According to an embodiment of the disclosure, the at least one processor is configured to determine the cleaner state information by determining the transition of cleaner state based on a plane separated from the hyperplane by a preset value.

According to an embodiment of the disclosure, the at least one processor is configured to use the plane separated from the hyperplane by the preset value based on the determination of the transition of cleaner state from a first state to a second state, and use a plane separated from the hyperplane by a negative value of the preset value based on the determination of the transition of cleaner state from the second state to the first state.

According to an embodiment of the disclosure, the at least one processor is configured to determine the cleaner state information based on the determined suction pressure, the load of the brush motor, and revolutions per minute (rpm) of the suction motor.

According to an embodiment of the disclosure, the at least one processor is configured to determine subsequent cleaner state information by further considering the rpm of the suction motor in addition to the determined suction pressure and the load of the brush motor based on the cleaner state information representing a lift state in which the brush is separated from a surface to be cleaned and the suction pressure being equal to or less than a preset value.

According to an embodiment of the disclosure, the at least one processor is configured to control an output of at least one of the brush motor and the suction motor based on the cleaner state information.

According to an embodiment of the disclosure, a method of controlling a vacuum cleaner, the vacuum cleaner including a main body, a suction head including a suction port through which debris is sucked up, a brush configured to rotate in the suction head, a brush motor configured to rotate the brush, and a suction motor configured to generate suction force so that debris is sucked up through the suction port, may include measuring, by a pressure sensor, atmospheric pressure and pressure at the suction port; determining suction pressure based on the measured atmospheric pressure and the measured pressure at the suction port; and determining cleaner state information including, at least one of operation state information and information of a type of surface to be cleaned, based on the determined suction pressure and a load of the brush motor.

According to an embodiment of the disclosure, the pressure sensor includes a relative pressure sensor including a first pressure sensor configured to measure the atmospheric pressure, and a second pressure sensor configured to measure the pressure at the suction port, and the relative pressure sensor is configured to output a difference between the atmospheric pressure measured by the first pressure sensor and the pressure at the suction port measured by the second pressure sensor.

According to an embodiment of the disclosure, the pressure sensor includes an absolute pressure sensor configured to measure the pressure at the suction port, and the determining of the suction pressure includes determining the atmospheric pressure based on an output of the pressure sensor before operation of the suction motor, and determining the pressure at the suction port based on an output of the pressure sensor during operation of the suction motor.

According to an embodiment of the disclosure, the determining of the cleaner state information includes using a hyperplane determined by a support vector machine (SVM) having previously determined suction pressures according to previously determined cleaner states and previously determined loads of the brush motor as training data to determine the cleaner state information.

According to an embodiment of the disclosure, the determining of the cleaner state information includes determining a transition of cleaner state based on the hyperplane to update the cleaner state information.

BRIEF DESCRIPTION OF THE DRAWINGS

These and/or other embodiments of the disclosure will become apparent and more readily appreciated from the following description of the embodiments, taken in conjunction with the accompanying drawings of which:

FIG. 9 is a diagram for describing an occasion when a vacuum cleaner controls at least one of a brush motor or a suction motor based on cleaner state information, according to an embodiment.

DETAILED DESCRIPTION

Figure 1:
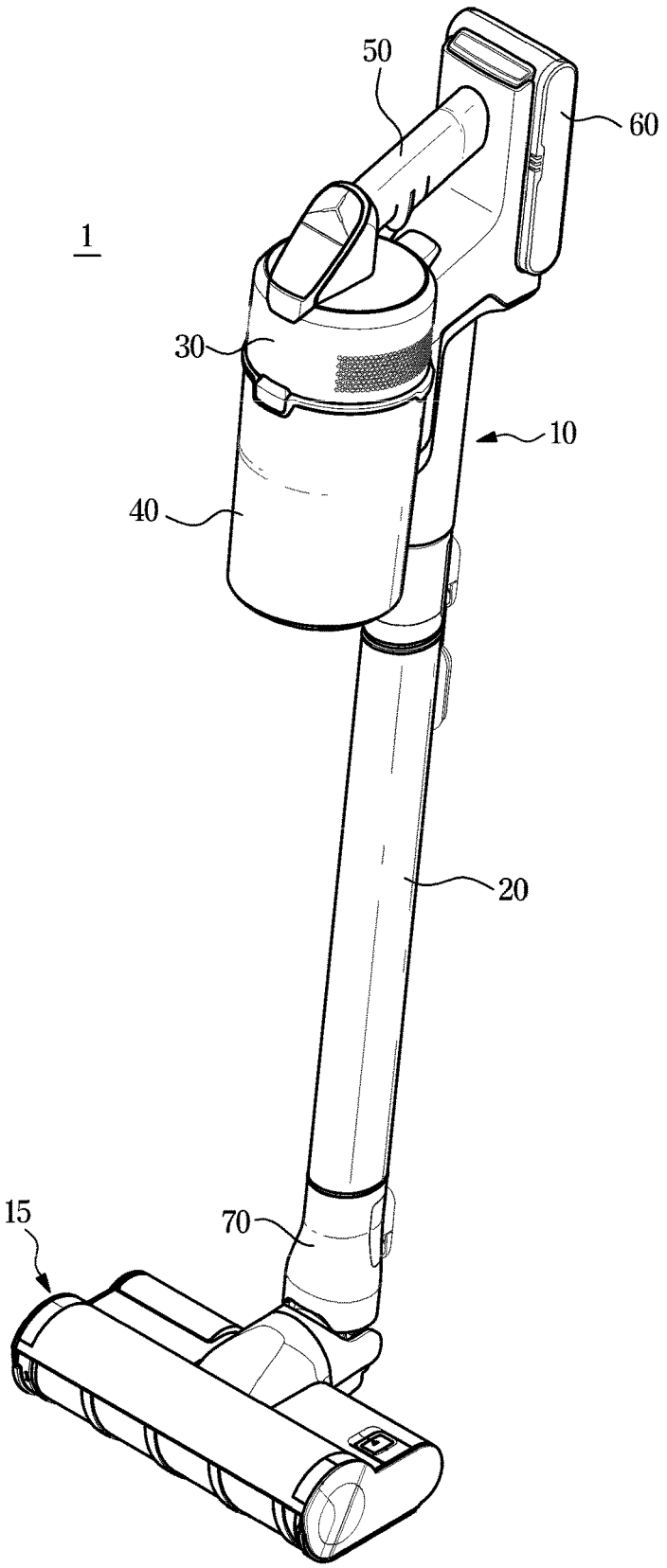
FIG. 1 is an exterior view of a vacuum cleaner, according to an embodiment.

Embodiments and features as described and illustrated in the disclosure are merely examples, and there may be various modifications replacing the embodiments and drawings at the time of filing this application.

It will be further understood that the term "connect" or its derivatives refer both to direct and indirect connection, and the indirect connection includes a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as "~part", "~block", "~member", module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

Embodiments of the disclosure may provide a vacuum cleaner and method for controlling the same, capable of accurately classifying cleaner states such as whether cleaning is performed or a type of a surface to be cleaned even with a change in external environment by measuring atmospheric pressure and pressure on a suction port side.

According to an embodiment, a vacuum cleaner and method for controlling the same may accurately classify cleaner states such as whether cleaning is performed or types of a surface to be cleaned even with a change in external environment by measuring atmospheric pressure and pressure at a suction port.

Reference will now be made in detail to embodiments of the disclosure, which are illustrated in the accompanying drawings.

FIG. 1 is an exterior view of a vacuum cleaner, according to an embodiment.

Referring to FIG. 1, a vacuum cleaner 1 may include a cleaner main body 10, a suction head 15, and an extension tube 20 connecting between the cleaner main body 10 and the suction head 15.

The cleaner main body 10 may include a suction force generator 30 for generating suction force, a debris collection chamber 40 for separating and collecting debris from air sucked up, a handle 50, and a battery 60 for supplying power to the suction force generator 30.

The suction force generator 30 may include a suction motor for converting electric power to mechanical rotational power and a suction fan connected to the suction motor to be rotated.

The debris collection chamber 40 may collect debris in a cyclonic method of using centrifugal force to separate the debris or in a dirtbag method of separating debris by forcing air to pass through a filter bag. The air from which the debris is removed through the debris collection chamber 40 may be discharged out of the cleaner main body 10.

The extension tube 20 may be formed with a flexible hose or a pipe having certain rigidity. The extension tube 20 may deliver suction force generated by the suction force generator 30 to the suction head 15, and guide air and debris sucked up through the suction head 15 to the cleaner main body 10.

The suction head 15 may closely contact a surface to be cleaned and suck up air and debris on the surface to be cleaned. The suction head 15 may be rotationally coupled with the extension tube 20.

Figure 2:
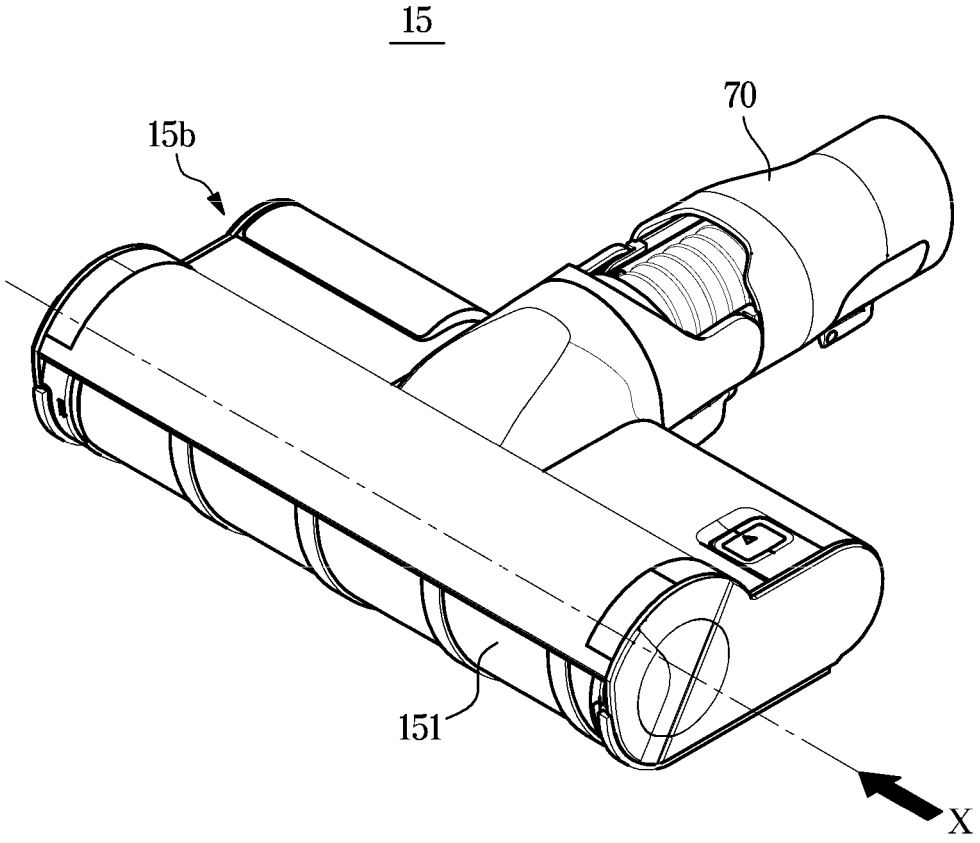
FIG. 2 is a perspective view of a suction head, according to an embodiment.
Figure 3:
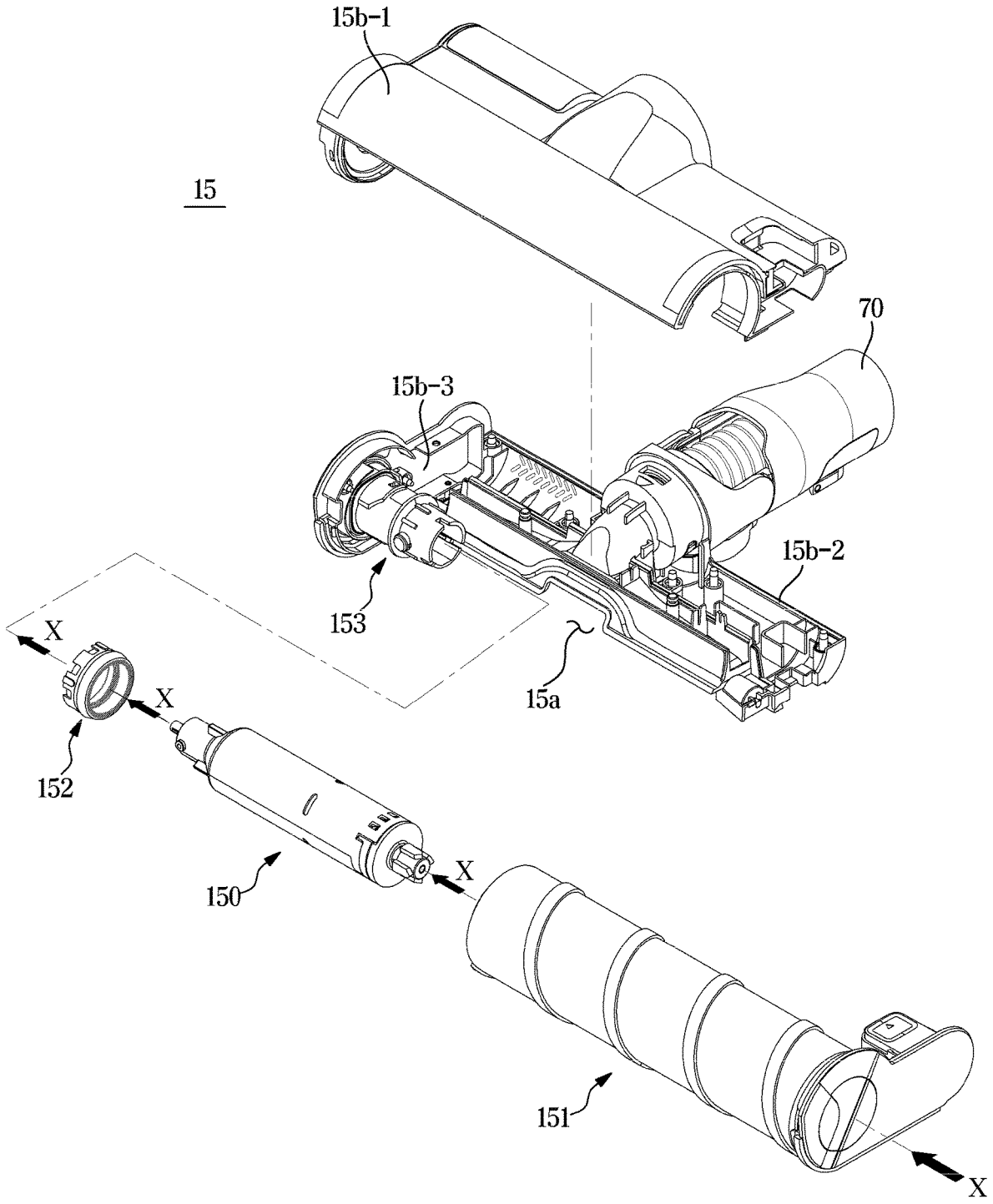
FIG. 3 is an exploded view of a suction head, according to an embodiment.

FIG. 2 is a perspective view of the suction head 15, according to an embodiment, and FIG. 3 is an exploded view of the suction head 15, according to an embodiment.

Referring to FIGS. 2 and 3, the suction head 15 may include a housing 15*b* with a suction port 15*a* formed thereon, a brush 151 that rotates for debris to be effectively sucked up into the housing 15*b* through the suction port 15*a*, and a suction connector 70 connecting the housing 15*b* to the extension tube 20.

In this case, a module coupling direction X may be defined along a rotational axis of the brush 151. A bearing module 152, a brush motor 150, and the brush 151 may be coupled to the housing 15*b* of the suction head 15 in the module coupling direction X.

For example, the housing 15*b* of the suction head 15 may be formed with an upper housing 15*b*-1, a lower housing 15*b*-2, and a side housing 15*b*-3 assembled.

In an embodiment, the suction head 15 may further include a connector module 153. The connector module 153 may be fixed to the side housing 15*b*-3. The connector module 153 may be coupled to the brush motor 150, and may supply power to drive the brush motor 150. An electric wire (not shown) for supplying power connected to the battery 60 may extend out to the cleaner main body 10, the extension tube 20, the suction connector 70, the lower housing 15*b*-2, and the side housing 15*b*-3 in sequence and may be finally and electrically connected to a connector of the connector module 153.

The brush motor 150 may be provided in the shape of substantially a bottle. Specifically, a case of the brush motor 150 provided to cover and protect detailed components may be shaped almost like a bottle. The shape of a bottle may refer to a form including a cylindrical body with a certain diameter and a neck connected to the body and having a smaller diameter than the diameter of the body.

A plug connected to the connector of the connector module 153 may be fixed to a section of the neck part of the bottle shape of the brush motor 150. A brush driving shaft may be arranged between one end at which the plug is placed and the other end in a direction of the rotational axis of the brush 151. Driving force generated from the brush motor 150 may be transferred to the brush 151 through the brush driving shaft.

The brush 151 may be provided in the form of a cylinder having an empty space formed therein along the rotational axis (X-axis), and the brush motor 150 may be settled in the empty space formed along the rotational axis.

The brush 151 may receive the connector module 153, the bearing module 152, and the brush motor 150 in the empty space formed along the rotational axis (X-axis) and may be fixed to the housing 15*b*.

With this, the brush 151 rotates based on the driving force transferred from the brush motor 150 to scatter the debris on the surface to be cleaned, helping suction of the debris through the suction port 15*a* be efficiently performed.

The suction head 15 shown in FIGS. 2 and 3 is an example of the disclosure, but the disclosure is not limited to the suction head 15 shown in FIGS. 2 and 3. For example, the brush motor 150 equipped in the suction head 15 may be provided in a way that transfers power through a pulley structure on the outside of the brush 151 instead of a way that transfers power through an interlocking structure in which the brush motor 150 is put into the brush 151. As such, the suction head 15 may have any structure that includes the suction port 15*a* and the brush 151 to increase suction force at the suction port 15*a* for the debris, without limitation.

Figure 4:
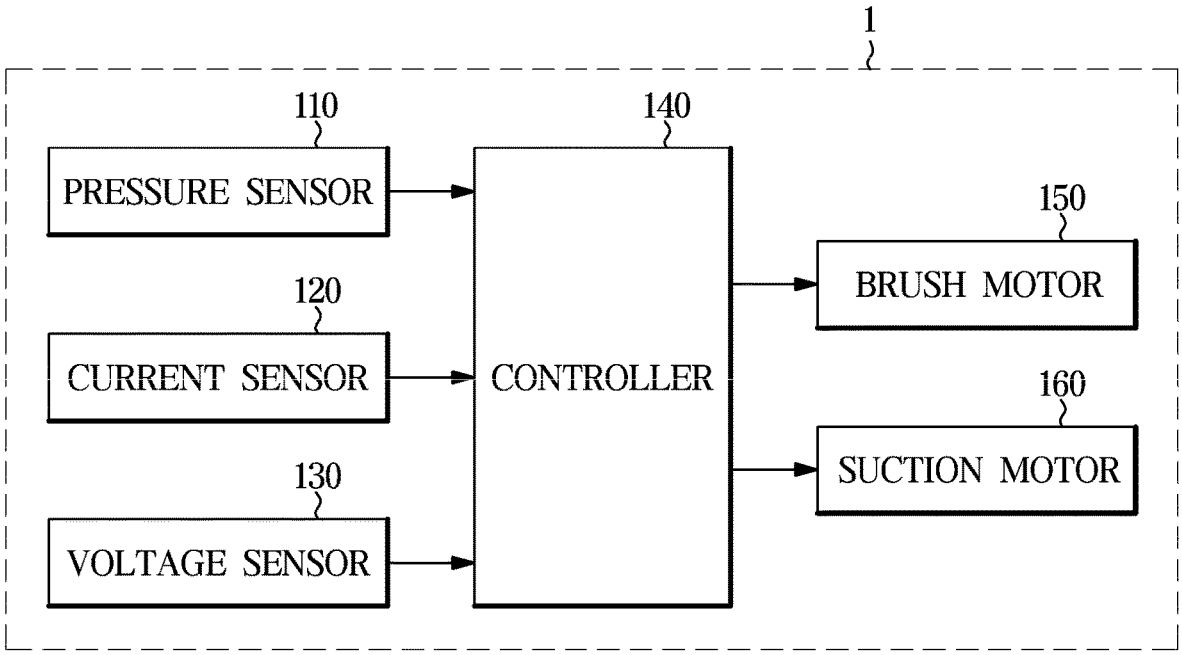
FIG. 4 is a control block diagram of a vacuum cleaner, according to an embodiment.

FIG. 4 is a control block diagram of the vacuum cleaner 1, according to an embodiment.

Referring to FIG. 4, the vacuum cleaner 1 according to an embodiment includes a pressure sensor 110 for detecting atmospheric pressure and pressure at the suction port 15*a*, a current sensor 120 for detecting a current applied to the brush motor 150, a voltage sensor 130 for detecting a voltage of the battery 60 which supplies power to the brush motor 150, a controller 140 for determining suction pressure based on a difference between the atmospheric pressure and the pressure at the suction port 15*a*, and determining cleaner state information including at least one of operation state information or type information of the surface to be cleaned based on the suction pressure and a load of the brush motor 150, the brush motor 150 for transferring driving force to the brush 151, and a suction motor 160 for transferring the driving power to a suction fan to produce suction force.

In an embodiment, the pressure sensor 110 may include a relative pressure sensor including a first pressure sensor for measuring atmospheric pressure and a second pressure sensor for measuring pressure at the suction port 15*a*, and outputting a difference between the first pressure sensor value and the second pressure sensor value. In this case, the first pressure sensor may be at any location at which to measure atmospheric pressure without limitation, and the second pressure sensor may be arranged on one side of the suction port 15*a* to measure pressure at the suction port 15*a*. Alternatively, the second pressure sensor may be arranged on one side of the suction connector 70 connected to the suction port 15*a* or the extension tube 20.

Furthermore, in an embodiment, the pressure sensor 110 may be an absolute pressure sensor for measuring pressure at the suction port 15*a*, and the controller 140 may determine atmospheric pressure based on an output of the pressure sensor 110 before operation of the suction motor 160 and determine pressure at the suction port 15*a* based on an output of the pressure sensor 110 during operation of the suction motor 160.

In an embodiment, the current sensor 120 may measure a current to the brush motor 150, and for this, may be provided as a known type of current sensor.

In an embodiment, the voltage sensor 130 may measure a voltage of the battery 60 for supplying the voltage to the brush motor 150 and for this, may be provided as a known type of voltage sensor. In other words, the voltage sensor 130 may measure a voltage applied to the brush motor 150 from the battery 60.

In an embodiment, the controller 140 may determine suction pressure based on the atmospheric pressure and the pressure at the suction port 15*a*. Specifically, the controller 140 may determine actual pressure applied to the debris by determining suction pressure corresponding to a difference between the atmospheric pressure and the pressure at the suction port 15*a* even when the atmospheric pressure changes by external environment. In other words, the controller 140 may accurately determine suction pressure corresponding to the actual pressure for sucking up the debris even when there is a change in atmospheric pressure by the external environment.

In an embodiment, the controller 140 may determine cleaner state information including at least one of operation state information or type information of the surface to be cleaned based on the suction pressure and a load of the brush motor 150.

In this case, the controller 140 in an embodiment may determine a load of the brush motor 150 based on the current to the brush motor 150. For example, when the brush 151 corresponds to a brush that is driven with a certain current, the applied current may increase to maintain certain rotational force for the brush based on resistance of the floor surface, and the controller 140 may determine that the load of the brush motor 150 increases when the applied current to the brush motor 150 increases.

Furthermore, in an embodiment, the controller 140 may determine consumption power of the brush motor 150 based on the current applied to the brush motor 150 and the voltage of the battery 60 that supplies power to the brush motor 150, and determine a load of the brush motor 150 in proportion to the consumption power of the brush motor 150. For example, when the brush 151 corresponds to a brush that is driven at certain rpm, the consumption power may increase to maintain the certain rpm based on resistance of the floor surface, and the controller 140 may determine that a load of the brush motor 150 increases when the consumption power to the brush motor 150 increases.

The controller 140 may use correlation information between suction pressure, a load of the brush motor 150, and a cleaner state determined based on the load of the brush motor 150 and the suction pressure according to the cleaner state to determine cleaner state information corresponding to the current suction pressure and the load of the brush motor 150.

For example, the controller 140 may use a hyperplane determined by a support vector machine (SVM) having the suction pressure according to the cleaner state and the load of the brush motor 150 as training data to determine the cleaner state information.

Specifically, the controller 140 may identify a region to which the current suction pressure and the load of the brush motor 150 belong among a plurality of regions separated by the hyperplane determined by the SVM to determine the cleaner state information.

In this case, the hyperplane may be a boundary plane which separates respective cleaner states differentiated by the suction pressure and the load of the brush motor 150.

Furthermore, the hyperplane in an embodiment may be a linear kernel to prevent overfitting for the training data.

In an embodiment, the hyperplane may be a hyperplane having a maximum separation distance from the training data in a space with the suction pressure and a load of the brush motor 150 as attributes.

In this case, the cleaner state information may include at least one of operation state information indicating whether the vacuum cleaner 1 performs cleaning or type information of a surface to be cleaned indicating a type of the surface to be cleaned when the vacuum cleaner 1 performs cleaning.

For example, the operation state information may include a lift state in which the brush 151 is separated from the surface to be cleaned and thus cleaning is not performed.

The type information of the surface to be cleaned may include information about each of a state in which the surface to be cleaned is a carpet, a state in which the surface to be cleaned is a hard floor, and a state in which the surface to be cleaned is a mat, and the state in which the surface to be cleaned is a carpet may include information about each of a state in which the surface to be cleaned is a low pile carpet (or carpet short), e.g., Wilton carpet, and a state in which the surface to be cleaned is a high pile carpet (or carpet long), e.g., Plush carpet.

In an embodiment, the controller 140 may determine transition of cleaner state based on the hyperplane to update the cleaner state information. Specifically, the controller 140 may use a state machine to determine transition of cleaner state, thereby determining the current cleaner state information.

For example, when a region to which the suction pressure and the load of the brush motor 150 belong among a plurality of regions separated by the hyperplane is changed a preset number of times or more, the controller 140 may determine the cleaner state information based on a cleaner state corresponding to the changed region.

Furthermore, in an embodiment, the controller 140 may determine cleaner state information by determining transition of cleaner state based on a plane separated from the hyperplane by a preset value. In this case, taking into account hysteresis characteristics, the controller 140 may use a plane separated from the hyperplane by the preset value based on determination of transition of the cleaner state from a first state to a second state, and use a plane separated from the hyperplane by a negative value of the preset value based on determination of transition of the cleaner state from the second state to the first state.

As such, the controller 140 may cancel noise based on an operation state or noise of the sensor 110, 120 or 130 by applying the hysteresis and figuring out continuity of data when the transition of the cleaner state may be determined.

Furthermore, in an embodiment, the controller 140 may determine the cleaner state information based on suction pressure, a load of the brush motor 150 and rpm of the suction motor 160.

In this case, the controller 140 may determine rpm of the suction motor 160 based on a motor position of the suction motor 160 according to an operation command. For example, the suction motor 160 may correspond to a brushless direct current (BLDC) motor, and the controller 140 may determine rpm of the suction motor 160 based on the motor position of the suction motor 160.

The controller 140 may use correlation information between suction pressure, a load of the brush motor 150, rpm of the suction motor 160 and a cleaner state determined based on the suction pressure according to the cleaner state, the load of the brush motor 150, and the rpm of the suction motor 160 to determine cleaner state information corresponding to the current suction pressure, the load of the brush motor 150, and the rpm of the suction motor 160.

For example, the controller 140 may use a hyperplane determined by an SVM having the suction pressure according to the cleaner state, the load of the brush motor 150 and the rpm of the suction motor 160 as training data to determine the cleaner state information.

In this case, the hyperplane may correspond to a boundary plane to separate respective cleaner states differentiated by suction pressure, a load of the brush motor 160 and rpm of the suction motor 160 in a three-dimensional (3D) space having the suction pressure, the load of the brush motor 150, and the rpm of the suction motor 160 as attributes.

Furthermore, the hyperplane in an embodiment may be a linear kernel to prevent overfitting for the training data.

In an embodiment, the hyperplane may be a hyperplane having a maximum separation distance from the training data in the 3D space with the suction pressure, the load of the brush motor 150, and the rpm of the suction motor 160 as attributes.

For example, the controller 140 may determine subsequent cleaner state information by further considering the rpm of the suction motor 160 in addition to the suction pressure and the load of the brush motor 150 based on the cleaner state information indicating the lift state in which the brush 151 is separated from the surface to be cleaned and the suction pressure being equal to or less than a preset value.

Specifically, in a state of low suction pressure, it may be difficult to distinguish the state in which the surface to be cleaned is a hard floor from the state in which the surface to be cleaned is a mat. In this case, when the state in which the surface to be cleaned is a mat, the surface of the mat is adsorbed to a flow path of the brush 151 and thus the flow volume is reduced, leading to a reduction in load of the suction motor 160 and an increase in rpm of the suction motor 160.

Accordingly, when the cleaner state information indicates the lift state in which the brush 151 is separated from the surface to be cleaned and the suction pressure is equal to or less than a preset value, the controller 140 may determine that the suction pressure is low and then determine subsequent cleaner state information by further considering the rpm of the suction motor 160 in addition to the suction pressure and the load of the brush motor 150.

In an embodiment, the controller 140 may control at least one output of the brush motor 150 or the suction motor 160 based on the cleaner state information.

For example, the controller 140 may control the suction motor 160 to produce a reference output when the surface to be cleaned is a hard floor, control the suction motor 160 to produce more than the reference output when the surface to be cleaned is a carpet, and control the suction motor 160 to produce less than the reference output when the surface to be cleaned is a mat. Furthermore, the controller 140 may minimize outputs of the brush motor 150 and the suction motor 160 when cleaning is not performed (in the lift state).

The controller 140 may include at least one memory for storing a program for carrying out the aforementioned and following operations, and at least one processor for executing the program.

In an embodiment, the brush motor 150 may transfer driving force to the brush 151 under the control of the controller 140 when cleaning is performed.

In an embodiment, the suction motor 160 may transfer driving force to the suction fan under the control of the controller 140 when cleaning is performed.

The control configuration of the vacuum cleaner 1 has thus far been described in detail. How the vacuum cleaner 1 determines the cleaner state information will now be described in detail.

Figure 5:
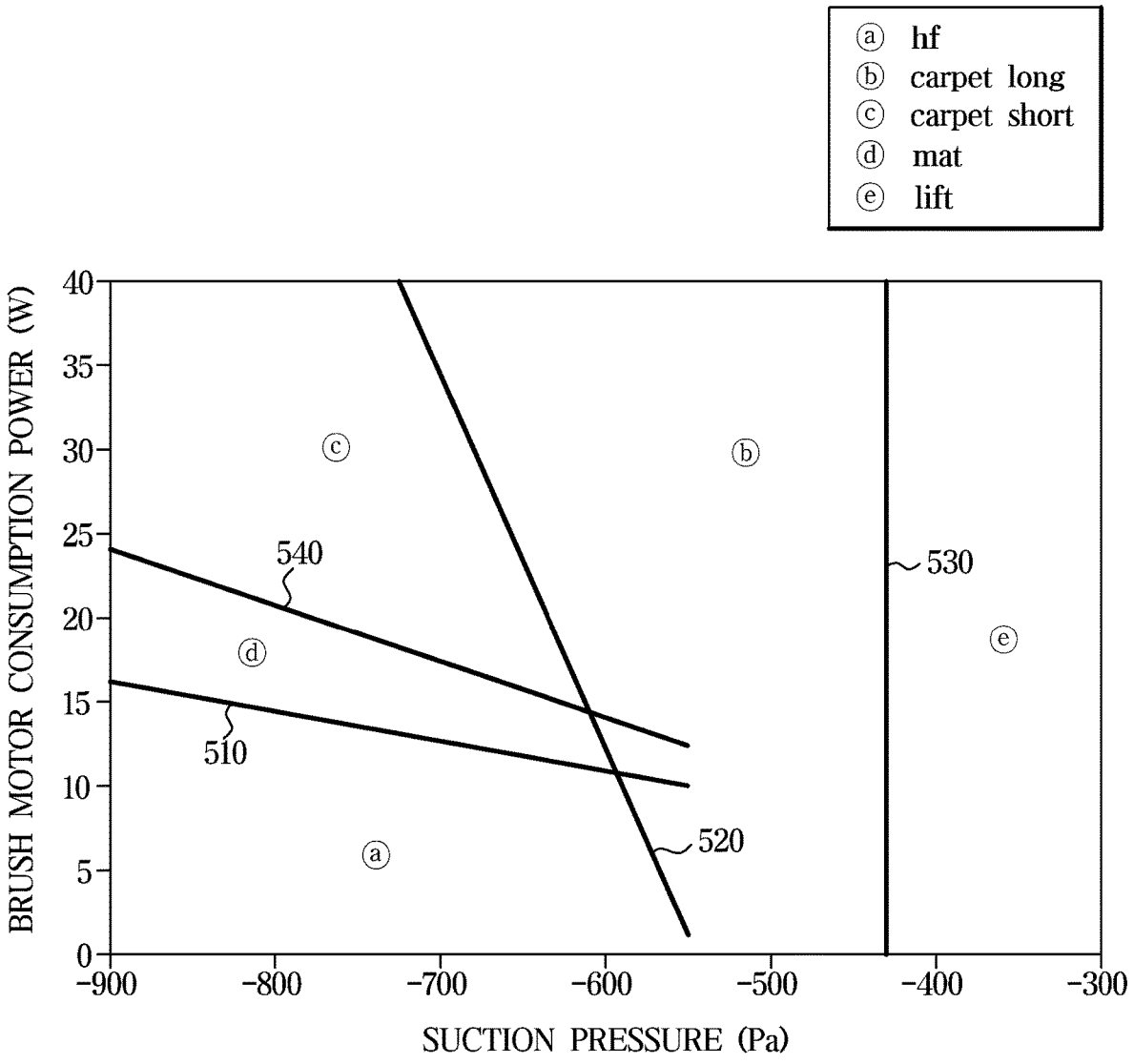
FIG. 5 is a diagram for describing how a vacuum cleaner determines cleaner state information, according to an embodiment.
Figure 6:
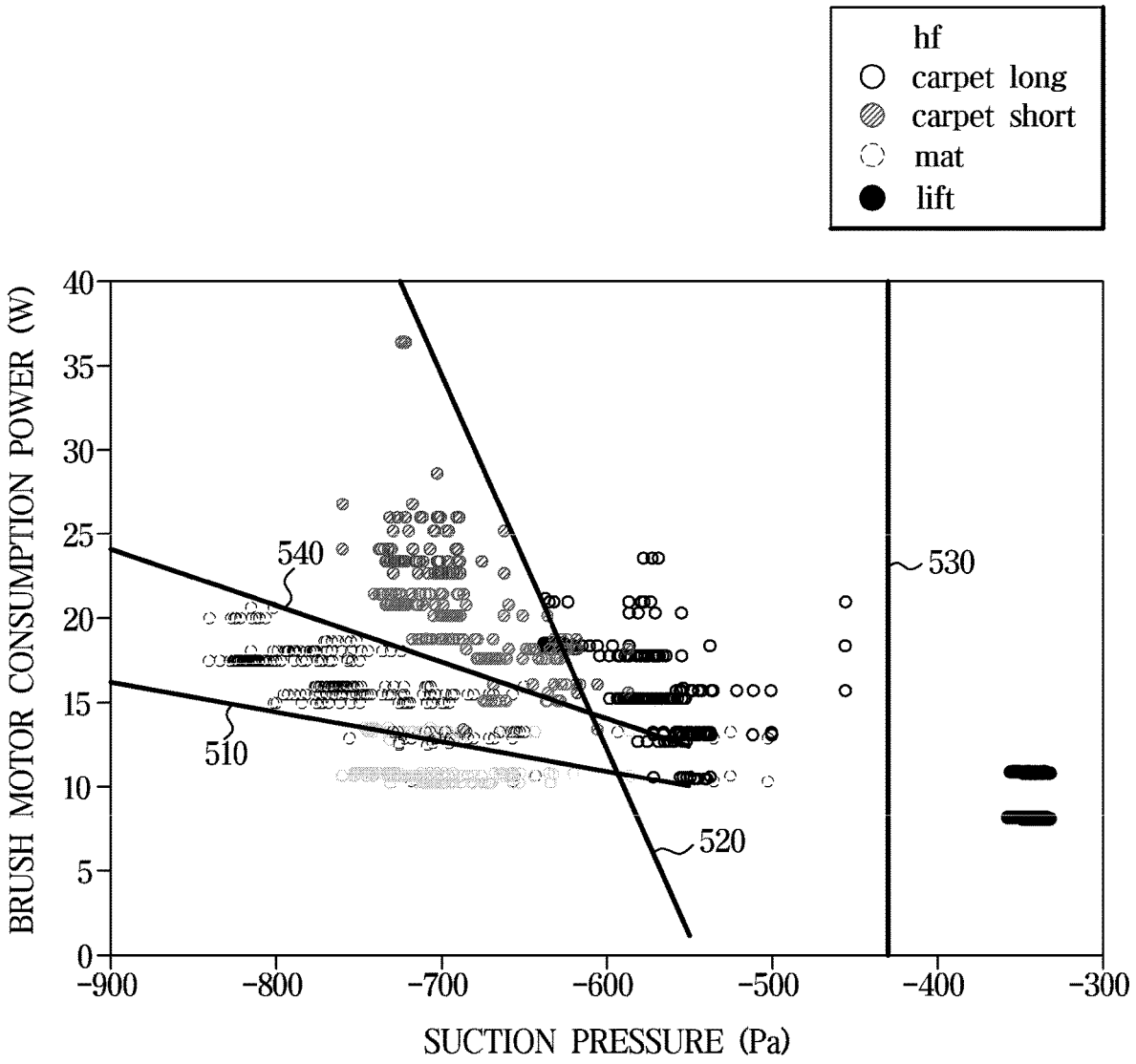
FIG. 6 is a diagram for describing hyperplanes determined by a support vector machine (SVM) according to an embodiment.

FIG. 5 is a diagram for describing how the vacuum cleaner 1 determines cleaner state information, according to an embodiment, and FIG. 6 is a diagram for describing hyperplanes determined by an SVM.

Referring to FIG. 5, in an embodiment, the vacuum cleaner 1 may determine cleaner state information including at least one of operation state information or type information of the surface to be cleaned based on the suction pressure and the load of the brush motor 150.

In this case, the load of the brush motor 150 may be determined based on a supply current applied to the brush motor 150 or consumption power of the brush motor 150, and an example of determining the load of the brush motor 150 based on the consumption power of the brush motor 150 will now be described.

The vacuum cleaner 1 may use correlation information between suction pressure, a load of the brush motor 150, and a cleaner state determined based on the load of the brush motor 150 and the suction pressure according to the cleaner state to determine cleaner state information corresponding to the current suction pressure and the load of the brush motor 150.

Specifically, the vacuum cleaner 1 may identify a region to which the current suction pressure and the load of the brush motor 150 belong among a plurality of regions ⓐ, ⓑ, ⓒ, ⓓ, and ⓔ separated by hyperplanes 510, 520, 530 and 540 determined by the SVM to determine the cleaner state information.

In this case, the cleaner state information may include at least one of operation state information indicating whether the vacuum cleaner 1 performs cleaning or type information of a surface to be cleaned indicating a type of the surface to be cleaned when the vacuum cleaner 1 performs cleaning.

For example, the operation state information may include the lift state in which the brush 151 is separated from the surface to be cleaned and thus cleaning is not performed.

The type information of the surface to be cleaned may include information about each of a state in which the surface to be cleaned is a carpet, a state in which the surface to be cleaned is a hard floor, and a state in which the surface to be cleaned is a mat, and the state in which the surface to be cleaned is a carpet may include information about each of a state in which the surface to be cleaned is a low pile carpet (or carpet short), e.g., Wilton carpet, and a state in which the surface to be cleaned is a high pile carpet (or carpet long), e.g., Plush carpet.

For example, when the current suction pressure and the load of the brush motor 150 belong to region ⓐ separated by the hyperplanes 510 and 520, the vacuum cleaner 1 may determine the cleaner state information as indicating that the surface to be cleaned is a hard floor.

Furthermore, when the current suction pressure and the load of the brush motor 150 belong to region ⓑ separated by the hyperplanes 520 and 530, the vacuum cleaner 1 may determine the cleaner state information as indicating that the surface to be cleaned is a high pile carpet (carpet long).

When the current suction pressure and the load of the brush motor 150 belong to region ⓒ separated by the hyperplanes 520 and 540, the vacuum cleaner 1 may determine cleaner state information as indicating that the surface to be cleaned is a low pile carpet (carpet short).

When the current suction pressure and the load of the brush motor 150 belong to region ⓓ separated by the hyperplanes 510 and 540, the vacuum cleaner 1 may determine the cleaner state information as indicating that the surface to be cleaned is a mat.

When the current suction pressure and the load of the brush motor 150 belong to region ⓔ separated by the hyperplane 530, the vacuum cleaner 1 may determine the cleaner state information as indicating the lift state in which cleaning is not performed because of separation from the surface to be cleaned.

In this case, the hyperplanes 510, 520, 530 and 540 may be determined by an SVM having the load of the brush motor and the suction pressure according to the cleaner state as training data, as shown in FIG. 6.

The hyperplanes 510, 520, 530 and 540 may be boundary planes which separate respective cleaner states differentiated by the load of the brush motor 150 and the suction pressure.

Furthermore, the hyperplanes 510, 520, 530 and 540 may be linear kernels to prevent overfitting for the training data in an embodiment.

Moreover, the hyperplanes 510, 520, 530 and 540 may be hyperplanes having maximum separation distances from the training data in a space with the suction pressure and a load of the brush motor 150 as attributes in an embodiment.

As in the training data of FIG. 6, the load of the brush motor 150 (consumption power W of the brush motor 150) is proportional to resistance between the surface to be cleaned and the brush 151, and may thus decrease in the order of the high profile carpet, the low profile carpet, the mat, the hard floor, and the lift state, and the absolute value of the suction pressure is affected by flow path forming conditions and may thus decrease in the order of the mat, the hard floor, the low profile carpet, the high profile carpet, and the lift state.

Figure 7:
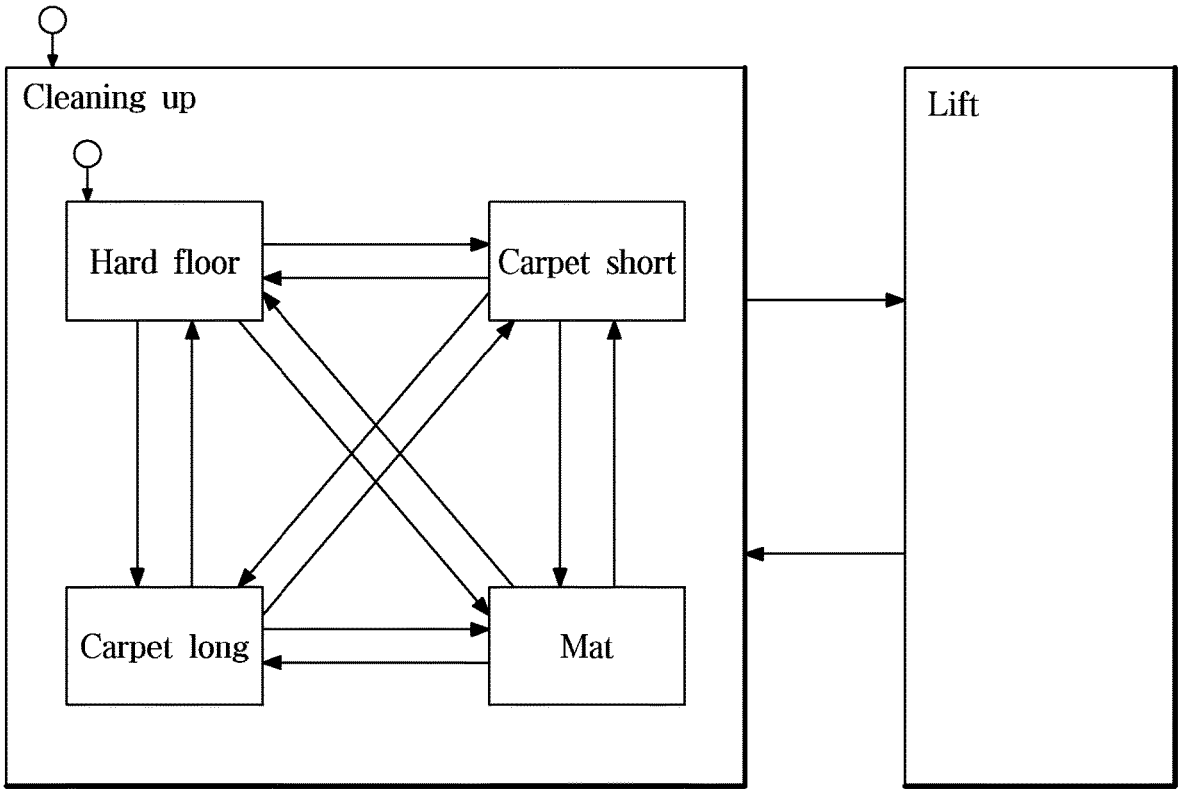
FIG. 7 is a diagram for describing how a vacuum cleaner determines cleaner state information based on transition of cleaner state, according to an embodiment.
Figure 8:
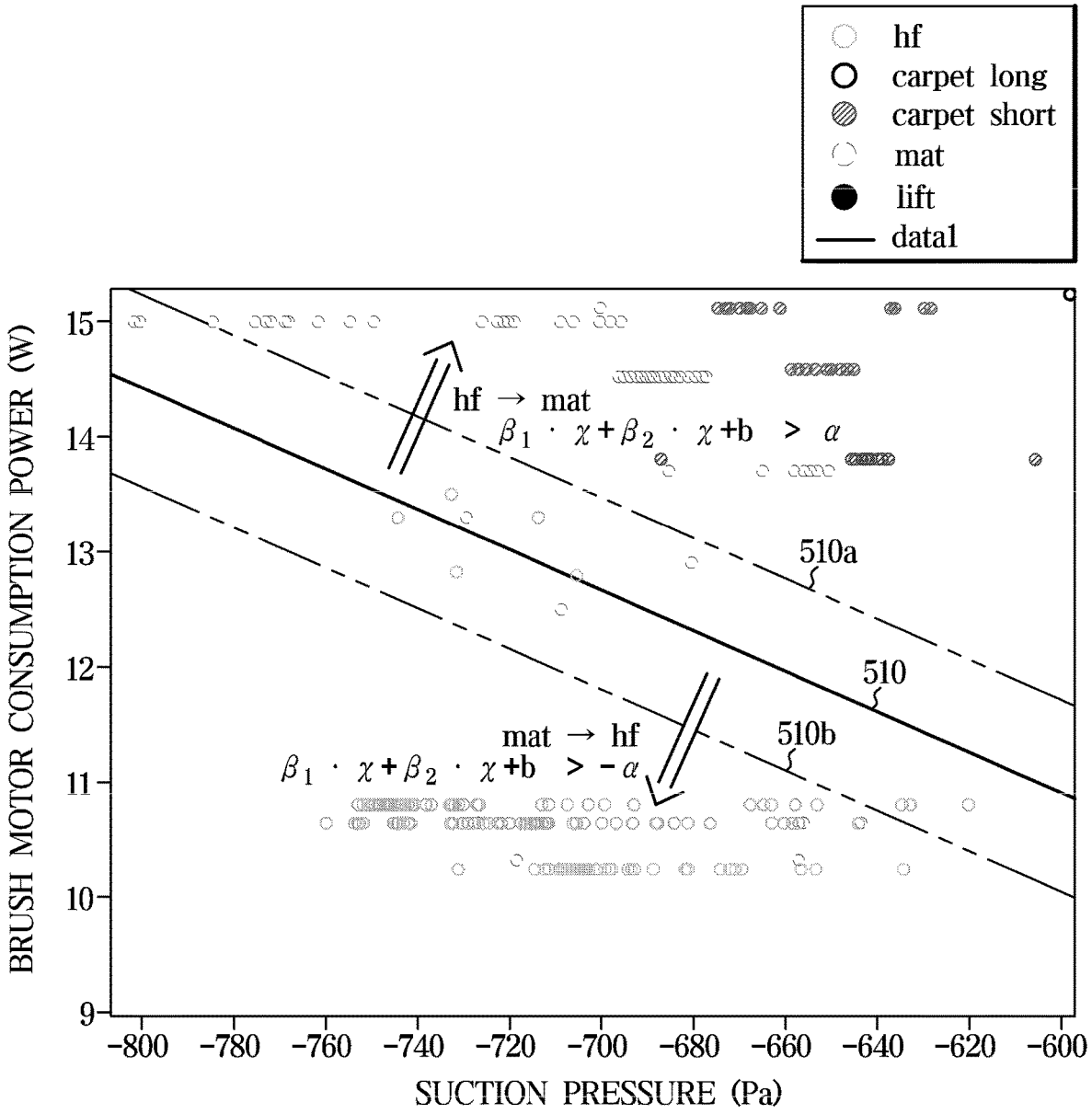
FIG. 8 is a diagram for describing how a vacuum cleaner determines state transition of the vacuum cleaner, according to an embodiment.

FIG. 7 is a diagram for describing how the vacuum cleaner 1 determines cleaner state information based on transition of cleaner state, according to an embodiment, and FIG. 8 is a diagram for describing how the vacuum cleaner 1 determines state transition of the vacuum cleaner 1, according to an embodiment.

Referring to FIG. 7, the vacuum cleaner 1 may determine transition of cleaner state based on the hyperplane to update the cleaner state information. Specifically, the vacuum cleaner 1 may use a state machine to determine transition of cleaner state, thereby determining current cleaner state information.

For example, when the region to which the suction pressure and the load of the brush motor 150 belong among a plurality of regions separated by the hyperplane is changed a preset number of times or more, the vacuum cleaner 1 may determine the cleaner state information based on a cleaner state corresponding to the changed region.

Specifically, the vacuum cleaner 1 may determine a state of the vacuum cleaner 1 based on state transition from one of the lift state in which the brush 151 is separated from the surface to be cleaned and cleaning is not performed, a state in which the surface to be cleaned is a hard floor, a state in which the surface to be cleaned is a mat, a state in which the surface to be cleaned is a carpet, which is one of a state in which the surface to be cleaned is a low profile carpet (carpet short), e.g., Wilton carpet or a state in which the surface to be cleaned is a high profile carpet (carpet long), e.g., Plush carpet, to another state, and create cleaner state information corresponding to the state of the vacuum cleaner 1.

Furthermore, in an embodiment, the vacuum cleaner 1 may determine cleaner state information by determining transition of cleaner state based on a plane separated from the hyperplane by a preset value. In this case, taking into account hysteresis characteristics, the vacuum cleaner 1 may use the plane separated from the hyperplane by the preset value based on determination of transition of the cleaner state from a first state to a second state, and use a plane separated from the hyperplane by a negative value of the preset value based on determination of transition of the cleaner state from the second state to the first state.

For example, the vacuum cleaner 1 may determine transition of cleaner state based on a plane separated by a preset value $\alpha$ from the hyperplane 510, $(\beta_1 \cdot x, \beta_2 \cdot x+b)$, between a state in which the surface to be cleaned is a hard floor and a state in which the surface to be cleaned is a mat, as shown in FIG. 8. In this case, taking into account hysteresis characteristics, the vacuum cleaner 1 may use a plane 510*a* separated from the hyperplane 510 by a preset value $\alpha$ based on determination of transition of the cleaner state from the state in which the surface to be cleaned is a hard floor (hf) to the state in which the surface to be cleaned is a mat, and use a plane 510*b* separated from the hyperplane 510 by a negative value of the preset value $\alpha$, i.e., $-\alpha$, based on determination of transition of the cleaner state from the state in which the surface to be cleaned is the mat to the state in which the surface to be cleaned is the hard floor.

As such, when the vacuum cleaner 1 is able to determine the transition of the cleaner state, the vacuum cleaner 1 may cancel noise based on an operation state or noise of the sensor 110, 120 or 130 by applying the hysteresis and figuring out continuity of data.

FIG. 9 is a diagram for describing an occasion when the vacuum cleaner 1 controls at least one of the brush motor 150 or the suction motor 160 based on cleaner state information, according to an embodiment.

Referring to FIG. 9, in an embodiment, the vacuum cleaner 1 may control at least one output of the brush motor 150 or the suction motor 160 based on the cleaner state information.

For example, the vacuum cleaner 1 may control the suction motor 160 to produce a reference output when the surface to be cleaned is a hard floor, control the suction motor 160 to produce more than the reference output when the surface to be cleaned is a carpet, and control the suction motor 160 to produce less than the reference output when the surface to be cleaned is a mat. Furthermore, the vacuum cleaner 1 may minimize outputs of the brush motor 150 and the suction motor 160 when cleaning is not performed (in the lift state).

With this, the vacuum cleaner 1 may control outputs of the brush motor 150 and the suction motor 160 by figuring out a cleaner state (whether the cleaner is working, or a type of the surface to be cleaned) to increase use time and increase operating force of the user, thereby giving convenience to the user.

Figure 10:
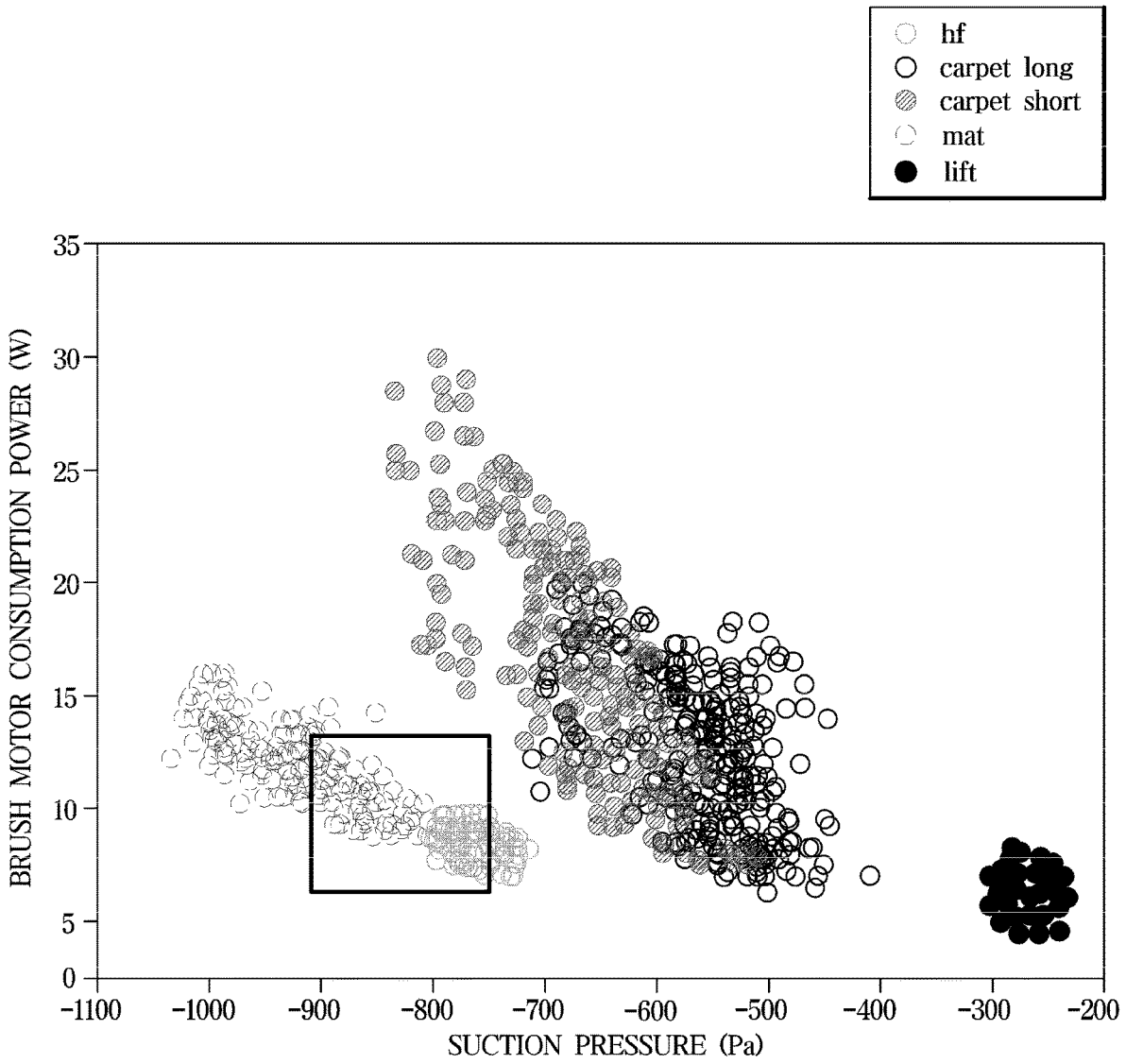
FIG. 10 is a diagram for describing cleaning state information when suction pressure of a vacuum cleaner is low, according to an embodiment.
Figure 11:
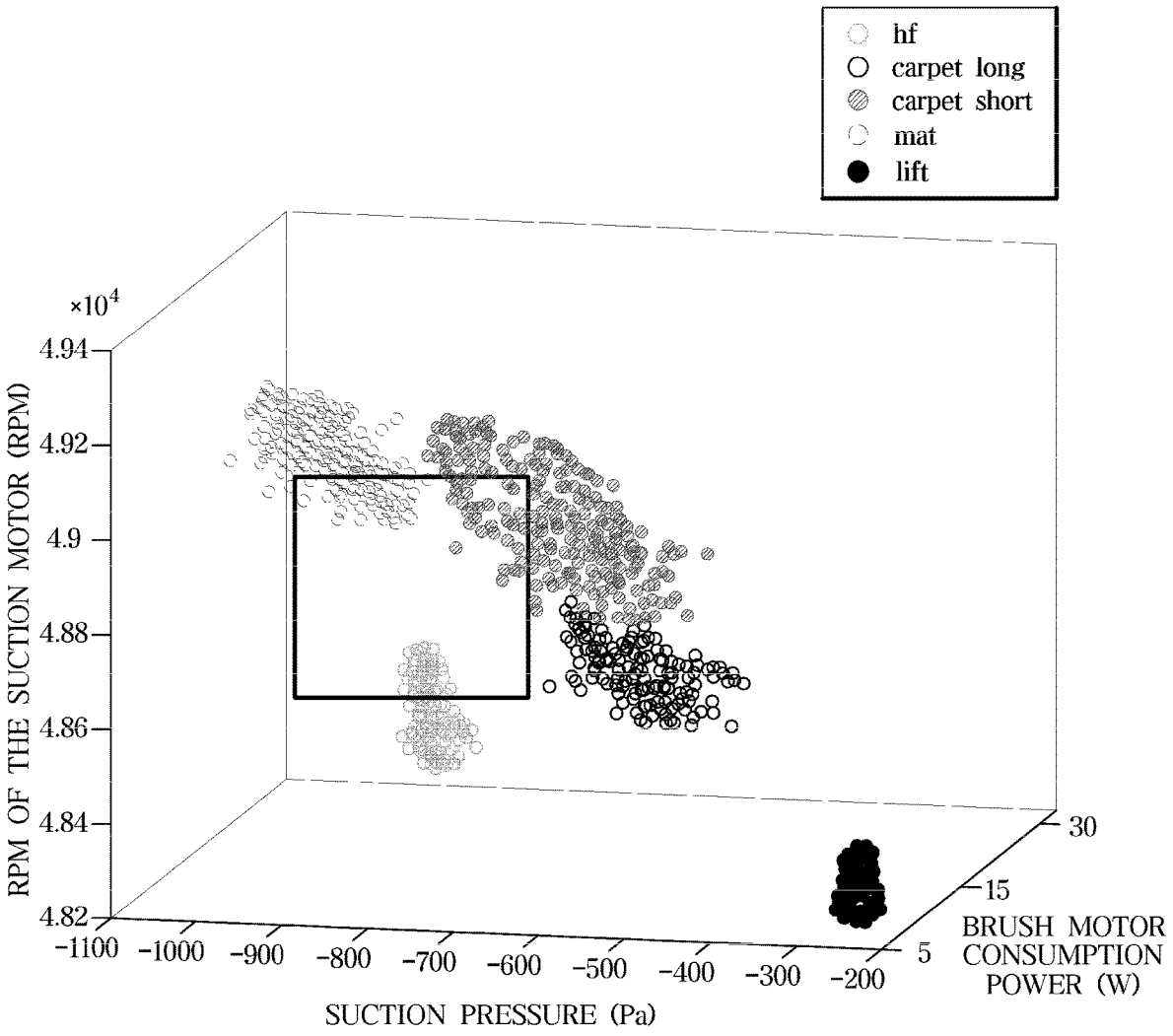
FIG. 11 is a diagram for describing how a vacuum cleaner determines cleaner state information by further considering revolutions per minute (rpm) of a suction motor, according to an embodiment.

FIG. 10 is a diagram for describing cleaning state information when suction pressure of the vacuum cleaner 1 is low, according to an embodiment, and FIG. 11 is a diagram for describing how the vacuum cleaner 1 determines cleaner state information by further considering rpm of the suction motor 160, according to an embodiment.

Referring to FIG. 10, in a state of low suction pressure, it may be difficult to differentiate the state in which the surface to be cleaned is a hard floor from the state in which the surface to be cleaned is a mat as shown in the box.

Specifically, when the vacuum cleaner 1 determines cleaner state information based on suction pressure and the load of the brush motor 150 in the state of low suction pressure, there may sometimes be overlapping of data representing the state in which the surface to be cleaned is a hard floor and the state in which the surface to be cleaned is a mat.

In this case, when the state in which the surface to be cleaned is a mat, the surface of the mat is adsorbed to a flow path of the brush 151 and thus the flow volume is reduced, leading to a reduction in load of the suction motor 160 and thus an increase in rpm of the suction motor 160.

Hence, the vacuum cleaner 1 may determine the cleaner state information based on suction pressure, a load of the brush motor 150 and rpm of the suction motor 160, as shown in FIG. 11.

For example, the vacuum cleaner 1 may determine subsequent cleaner state information by further considering the rpm of the suction motor 160 in addition to the suction pressure and the load of the brush motor 150 based on the cleaner state information indicating the lift state in which the brush 151 is separated from the surface to be cleaned and the suction pressure being equal to or less than a preset value.

Accordingly, when the cleaner state information indicates the lift state in which the brush 151 is separated from the surface to be cleaned and the suction pressure is equal to or less than a preset value, the vacuum cleaner 1 may determine that the suction pressure is low and then determine subsequent cleaner state information by further considering the rpm of the suction motor 160 in addition to the suction pressure and the load of the brush motor 150.

In this case, the vacuum cleaner 1 may determine rpm of the suction motor 160 based on a motor position of the suction motor 160 according to an operation command. For example, the suction motor 160 may correspond to a BLDC motor, and the vacuum cleaner 1 may determine rpm of the suction motor 160 based on the motor position of the suction motor 160.

The vacuum cleaner 1 may use correlation information between suction pressure, a load of the brush motor 150, rpm of the suction motor 160 and a cleaner state determined based on the suction pressure according to the cleaner state, the load of the brush motor 150, and the rpm of the suction motor 160 to determine cleaner state information corresponding to the current suction pressure, the load of the brush motor 150 and the rpm of the suction motor 160.

For example, the vacuum cleaner 1 may use a hyperplane determined by an SVM having the suction pressure according to the cleaner state, the load of the brush motor 150, and the rpm of the suction motor 160 as training data to determine the cleaner state information.

In this case, the hyperplane may correspond to a boundary plane to separate respective cleaner states differentiated by suction pressure, a load of the brush motor 160 and rpm of the suction motor 160 in a 3D space having the suction pressure, the load of the brush motor 150, and the rpm of the suction motor 160 as attributes.

Furthermore, the hyperplane in an embodiment may be a linear kernel to prevent overfitting for the training data.

In an embodiment, the hyperplane may be a hyperplane having a maximum separation distance from the training data in the 3D space with the suction pressure, the load of the brush motor 150, and the rpm of the suction motor 160 as attributes.

An embodiment of a method of controlling the vacuum cleaner 1 will now be described from a perspective. For the method of controlling the vacuum cleaner 1, the vacuum cleaner 1 in the aforementioned embodiments may be used. Hence, what are described above with reference to FIGS. 1 to 11 may be equally applied in the following method of controlling the vacuum cleaner 1.

Figure 12:
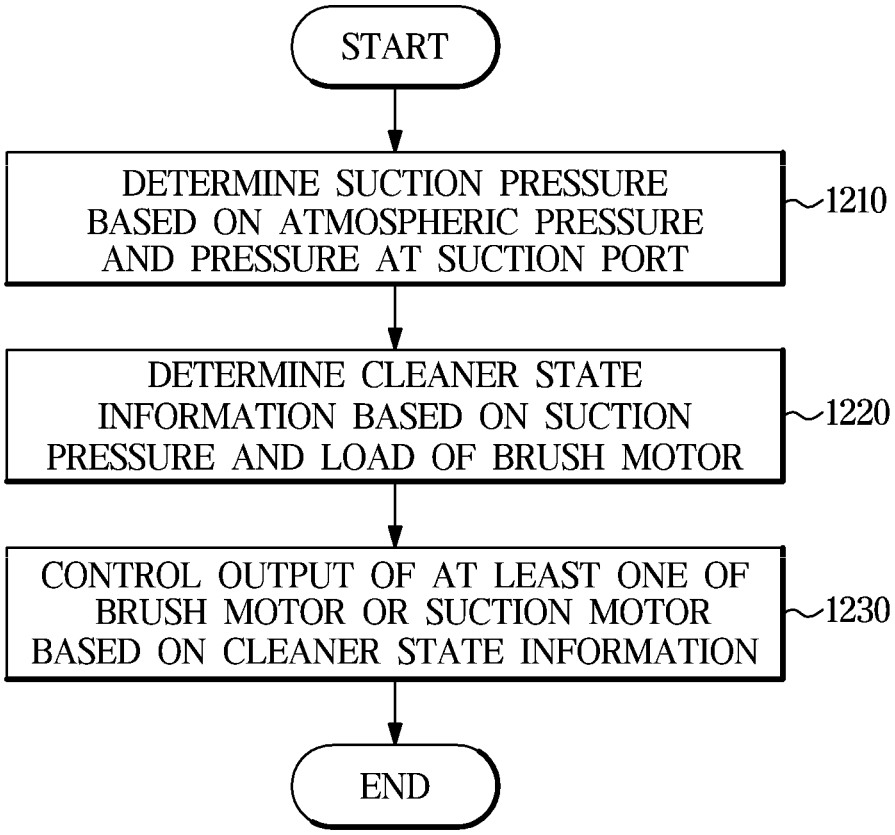
FIG. 12 is a flowchart of performing motor output control by determining cleaner state information in a method of controlling a vacuum cleaner, according to an embodiment.

FIG. 12 is a flowchart of performing motor output control by determining cleaner state information in a method of controlling the vacuum cleaner 1, according to an embodiment.

Referring to FIG. 12, the vacuum cleaner 1 according to an embodiment may determine suction pressure based on atmospheric pressure and pressure at the suction port 15*a*, in 1210.

In an embodiment, the vacuum cleaner 1 may determine cleaner state information based on the suction pressure and a load of the brush motor 150, in 1220.

Specifically, the vacuum cleaner 1 may use correlation information between the suction pressure, the load of the brush motor 150, and the cleaner state determined based on the load of the brush motor 150 and the suction pressure according to the cleaner state to determine the cleaner state information corresponding to the load of the brush motor 150 and the current suction pressure.

In an embodiment, the vacuum cleaner 1 may control at least one output of the brush motor 150 or the suction motor 160 based on the cleaner state information, in 1230.

For example, the vacuum cleaner 1 may control the suction motor 160 to produce a reference output when the surface to be cleaned is a hard floor, control the suction motor 160 to produce more than the reference output when the surface to be cleaned is a carpet, and control the suction motor 160 to produce less than the reference output when the surface to be cleaned is a mat. Furthermore, the vacuum cleaner 1 may minimize outputs of the brush motor 150 and the suction motor 160 when cleaning is not performed (in the lift state).

Figure 13:
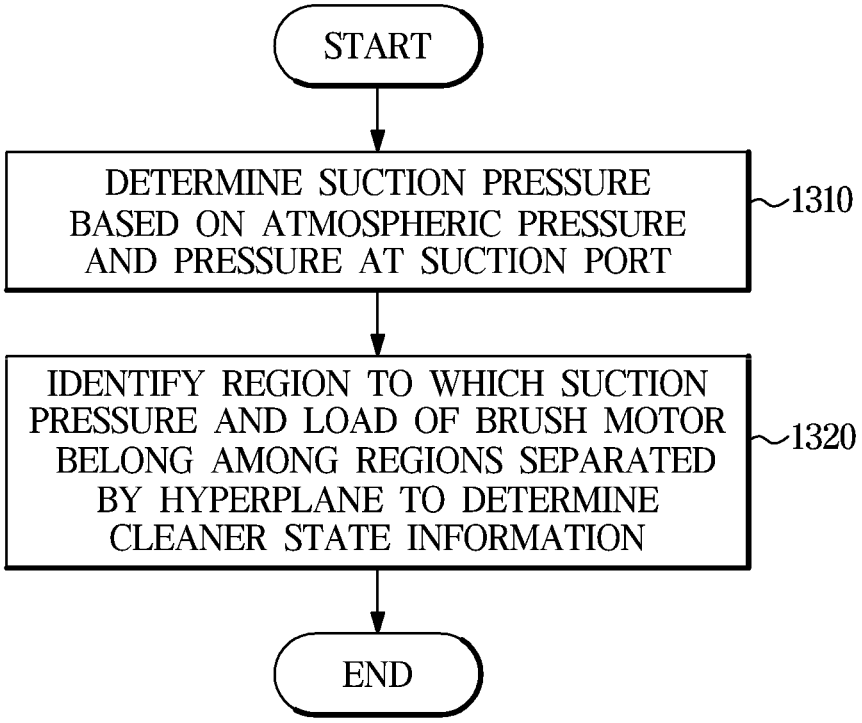
FIG. 13 is a flowchart of an example of determining cleaner state information in a method of controlling a vacuum cleaner, according to an embodiment.

FIG. 13 is a flowchart of an example of determining cleaner state information in a method of controlling the vacuum cleaner 1, according to an embodiment.

Referring to FIG. 13, the vacuum cleaner 1 according to an embodiment may determine suction pressure based on atmospheric pressure and pressure at the suction port 15*a*, in 1310.

In an embodiment, the vacuum cleaner 1 may identify a region to which the suction pressure and the load of the brush motor 150 belong among regions ⓐ, ⓑ, ⓒ, ⓓ, and ⓔ separated by the hyperplanes 510, 520, 530 and 540 to determine the cleaner state information, in 1320.

Specifically, the vacuum cleaner 1 may identify a region to which the current suction pressure and the load of the brush motor 150 belong among a plurality of regions ⓐ, ⓑ, ⓒ, ⓓ, and ⓔ separated by hyperplanes 510, 520, 530 and 540 determined by the SVM to determine the cleaner state information.

In this case, the cleaner state information may include at least one of operation state information indicating whether the vacuum cleaner 1 performs cleaning or type information of a surface to be cleaned indicating a type of the surface to be cleaned when the vacuum cleaner 1 performs cleaning.

For example, the operation state information may include a lift state in which the brush 151 is separated from the surface to be cleaned and thus cleaning is not performed.

The type information of the surface to be cleaned may include information about each of a state in which the surface to be cleaned is a carpet, a state in which the surface to be cleaned is a hard floor, and a state in which the surface to be cleaned is a mat, and the state in which the surface to be cleaned is a carpet may include information about each of a state in which the surface to be cleaned is a low pile carpet (or carpet short), e.g., Wilton carpet, and a state in which the surface to be cleaned is a high pile carpet (or carpet long), e.g., Plush carpet.

In this case, the hyperplanes 510, 520, 530, and 540 may be determined by an SVM having the load of the brush motor and the suction pressure according to the cleaner state as training data.

The hyperplanes 510, 520, 530, and 540 may be boundary planes which separate respective cleaner states differentiated by the load of the brush motor 150 and the suction pressure.

Furthermore, the hyperplanes 510, 520, 530, and 540 may be linear kernels to prevent overfitting for the training data in an embodiment.

Moreover, the hyperplanes 510, 520, 530, and 540 may be hyperplanes having maximum separation distances from the training data in a space with the suction pressure and a load of the brush motor 150 as attributes in an embodiment.

Figure 14:
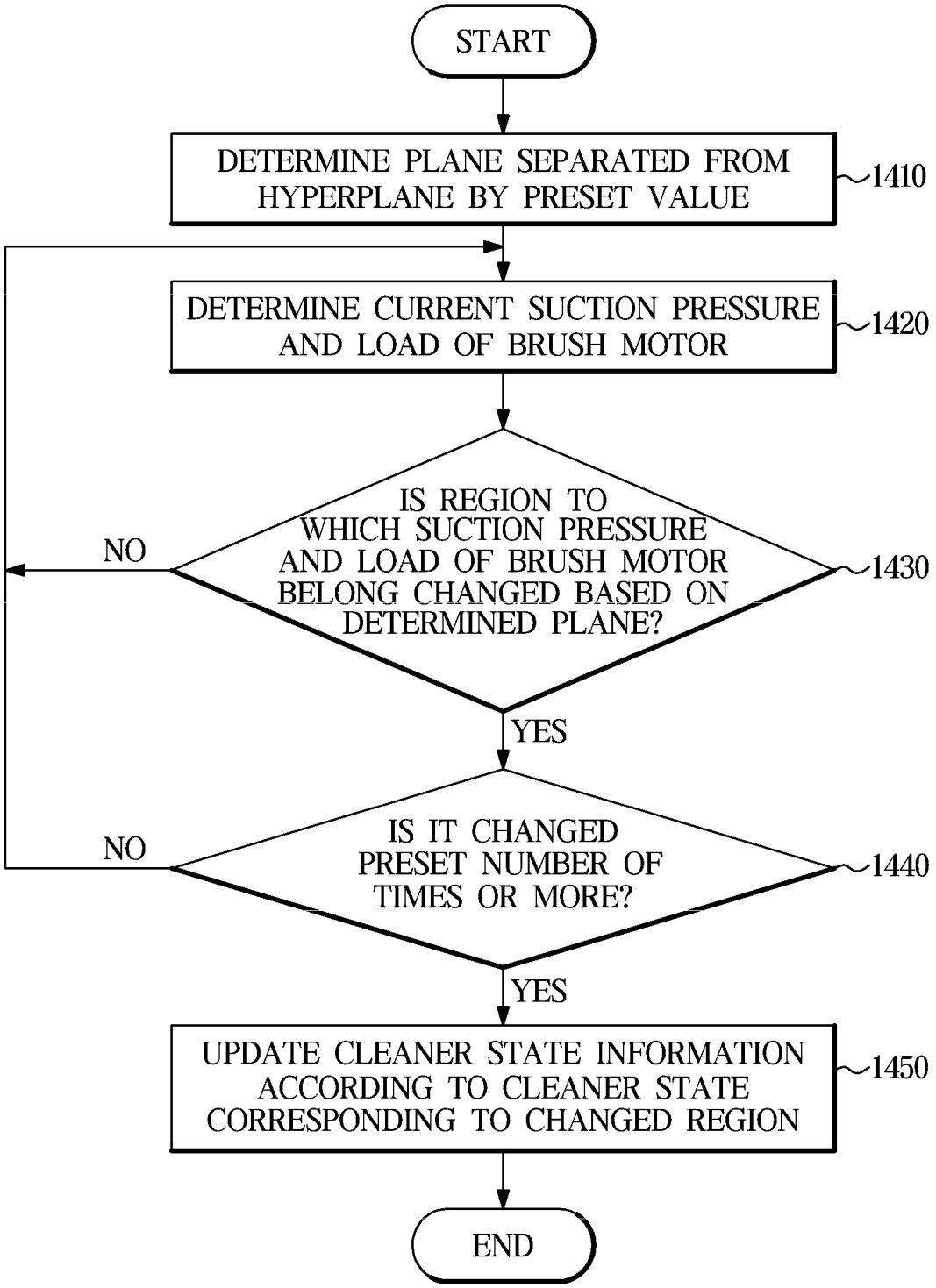
FIG. 14 is a flowchart of an example of determining cleaner state information based on state transition of a vacuum cleaner in a method of controlling the vacuum cleaner, according to an embodiment.

FIG. 14 is a flowchart of an example of determining cleaner state information based on state transition of a vacuum cleaner in a method of controlling the vacuum cleaner, according to an embodiment.

Referring to FIG. 14, the vacuum cleaner 1 in an embodiment may determine a plane separated from a hyperplane by a preset value in 1410, and determine current suction pressure and a load of the brush motor 150 in 1420.

In an embodiment, when a region to which suction pressure and a load of the brush motor 150 belong is changed with respect to the determined plane in 1430, and the change is made a preset number of times or more in 1440, the vacuum cleaner 1 may update cleaner state information based on a cleaner state corresponding to the changed region in 1450.

For example, when the region to which the suction pressure and the load of the brush motor 150 belong among a plurality of regions separated by hyperplanes is changed a preset number of times or more, the vacuum cleaner 1 may determine the cleaner state information based on a cleaner state corresponding to the changed region.

Furthermore, in an embodiment, the vacuum cleaner 1 may determine cleaner state information by determining transition of cleaner state based on a plane separated from a hyperplane by a preset value. In this case, taking into account hysteresis characteristics, the vacuum cleaner 1 may use the plane separated from the hyperplane by the preset value based on determination of transition of the cleaner state from a first state to a second state, and use a plane separated from the hyperplane by a negative value of the preset value based on determination of transition of the cleaner state from the second state to the first state.

As such, when the vacuum cleaner 1 is able to determine the transition of the cleaner state, the vacuum cleaner 1 may cancel noise based on an operation state or noise of the sensor 110, 120, or 130 by applying the hysteresis and figuring out continuity of data.

Figure 15:
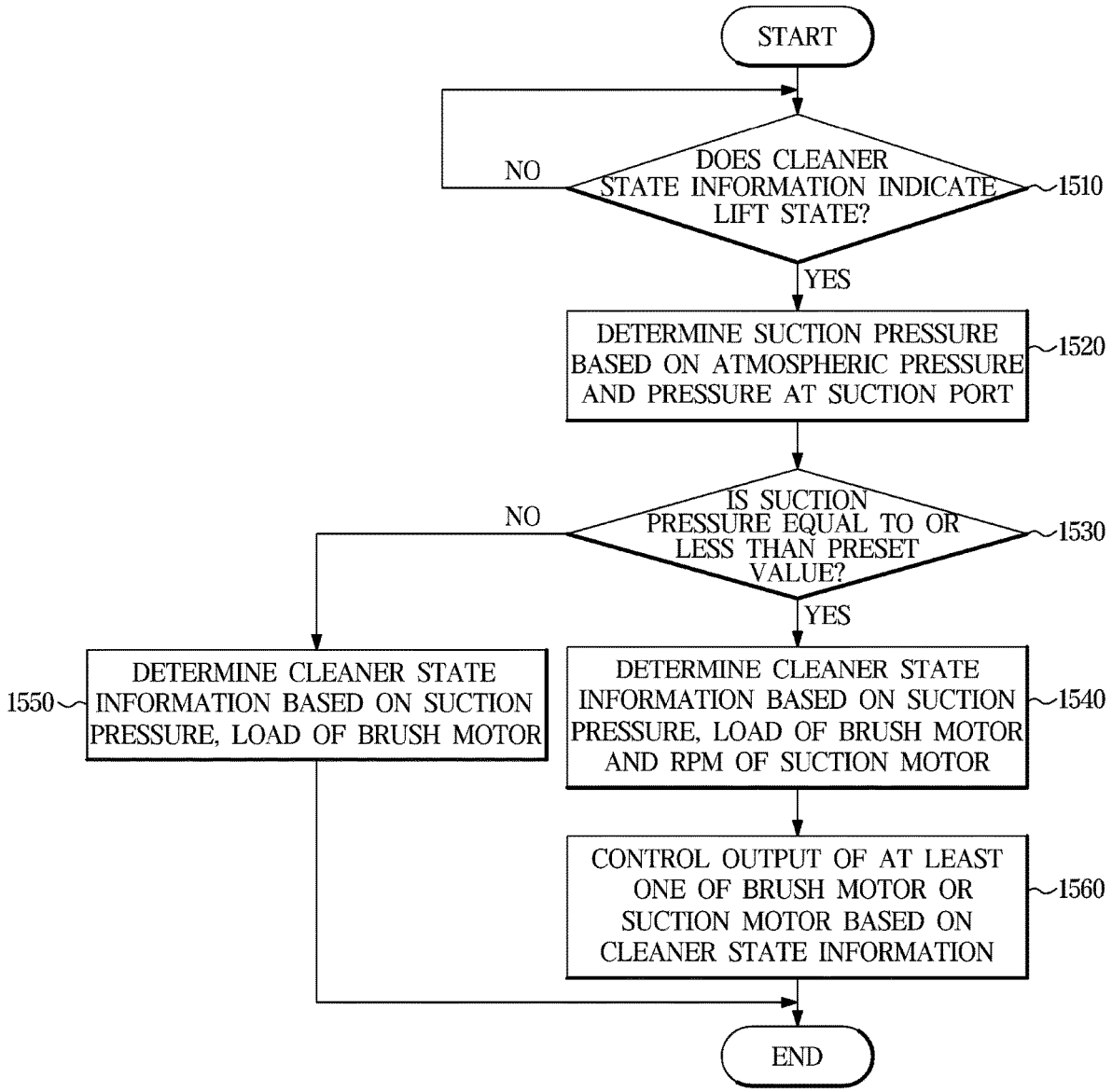
FIG. 15 is a flowchart of determining cleaner state information by further considering rpm of a suction motor in a method of controlling a vacuum cleaner, according to an embodiment.

FIG. 15 is a flowchart of determining cleaner state information by further considering rpm of the suction motor 160 in a method of controlling the vacuum cleaner 1, according to an embodiment.

Referring to FIG. 15, when the cleaner state information corresponds to the lift state in 1510, the vacuum cleaner 1 according to an embodiment may determine suction pressure based on atmospheric pressure and pressure at the suction port 15*a* in 1520.

In an embodiment, when the suction pressure is equal to or less than a preset value in 1530, the vacuum cleaner 1 may determine cleaner state information based on the suction pressure, the load of the brush motor 150, and the rpm of the suction motor 160 in 1540.

In this case, the vacuum cleaner 1 may determine rpm of the suction motor 160 based on a motor position of the suction motor 160 according to an operation command. For example, the suction motor 160 may correspond to a BLDC motor, and the vacuum cleaner 1 may determine rpm of the suction motor 160 based on the motor position of the suction motor 160.

The vacuum cleaner 1 may use correlation information between suction pressure, a load of the brush motor 150, rpm of the suction motor 160, and a cleaner state determined based on the suction pressure according to the cleaner state, the load of the brush motor 150, and the rpm of the suction motor 160 to determine cleaner state information corresponding to the current suction pressure, the load of the brush motor 150, and the rpm of the suction motor 160.

For example, the vacuum cleaner 1 may use hyperplanes determined by an SVM having the suction pressure according to the cleaner state, the load of the brush motor 150, and the rpm of the suction motor 160 as training data to determine the cleaner state information.

In this case, the hyperplanes may correspond to boundary planes to separate respective cleaner states differentiated by suction pressure, a load of the brush motor 160, and rpm of the suction motor 160 in a 3D space having the suction pressure, the load of the brush motor 150, and the rpm of the suction motor 160 as attributes.

Furthermore, the hyperplanes in an embodiment may be linear kernels to prevent overfitting for the training data.

In an embodiment, the hyperplanes may be hyperplanes having maximum separation distances from the training data in the 3D space with the suction pressure, the load of the brush motor 150, and the rpm of the suction motor 160 as attributes.

In an embodiment, when the suction pressure exceeds a preset value in 1530, the vacuum cleaner 1 may determine cleaner state information based on the suction pressure and a load of the brush motor 150, in 1550.

In an embodiment, the vacuum cleaner 1 may control at least one output of the brush motor 150 or the suction motor 160 based on the cleaner state information, in 1560.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a read only memory (ROM), a random access memory (RAM), a magnetic tape, a magnetic disk, a flash memory, an optical data storage device, etc.

The embodiments of the disclosure have thus far been described with reference to accompanying drawings. It will be obvious to those of ordinary skill in the art that the disclosure may be practiced in other forms than the embodiments of the disclosure as described above without changing the technical idea or essential features of the disclosure. The above embodiments of the disclosure are only by way of example, and should not be construed in a limited sense.

What is claimed is:

1. A vacuum cleaner comprising:

a main body;

a suction head including a suction port through which debris is sucked up;

a brush configured to rotate in the suction head;

a brush motor configured to rotate the brush;

a suction motor configured to generate suction force so that debris is sucked up through the suction port;

a pressure sensor configured to measure atmospheric pressure and pressure at the suction port;

a current sensor configured to measure current supplied to the brush motor;

a memory configured to store trained data of a support vector machine (SVM), wherein the trained data includes correlation information in form of suction pressure values stored in correspondence with brush motor load values, such that the correlation information represent a two-dimensional graph of the suction pressure values and the brush motor load values, resulting in the trained data further representing a plurality of information regions determinable by the SVM in the two-dimensional graph, an information region among the plurality of information regions corresponding to a different cleaner state among a plurality of cleaner states based upon the information region corresponding to a region of suction pressure values and a region of brush motor load values among the suction pressure values and the brush motor load values in the correlation information; and at least one processor configured to:

determine a currently determined suction pressure at the suction port based on the atmospheric pressure and the pressure measured by the pressure sensor, determine a currently determined load of the brush motor based on the current measured by the current sensor, determine a currently determined cleaner state among the plurality of cleaner states, based on the currently determined suction pressure, the currently determined load of the brush motor and the correlation information stored in the trained data by identifying an information region among the plurality of information regions to which the currently determined suction pressure and the currently determined load of the brush motor belong, the currently determined cleaner state including at least one of an operation state or a type of surface to be cleaned, and control an output of at least one motor among the brush motor and the suction motor, based on the currently determined cleaner state.

2. The vacuum cleaner of claim 1, wherein the pressure sensor includes a relative pressure sensor including:

a first pressure sensor configured to measure the atmospheric pressure, and a second pressure sensor configured to measure the pressure at the suction port, wherein to determine the currently determined suction pressure at the suction port, the relative pressure sensor is configured to output a difference between the atmospheric pressure measured by the first pressure sensor and the pressure at the suction port measured by the second pressure sensor.

3. The vacuum cleaner of claim 1, wherein the pressure sensor includes an absolute pressure sensor configured to measure the pressure at the suction port, and the at least one processor is configured to:

determine the atmospheric pressure based on a first output of the pressure sensor before operation of the suction motor, and determine the pressure at the suction port based on a second output of the pressure sensor during operation of the suction motor.

4. The vacuum cleaner of claim 1, further comprising:

a voltage sensor configured to measure a voltage of a battery which supplies power to the brush motor, wherein the at least one processor is configured to:

determine consumption power of the brush motor based on the current supplied to the brush motor and the voltage of the battery, and determine the currently determined load of the brush motor in proportion to the consumption power of the brush motor.

5. The vacuum cleaner of claim 1, wherein the plurality of information regions are delineated by a plurality of hyperplanes determined by the SVM based on the correlation information, each hyperplane among the plurality of hyperplanes being a boundary information plane in the trained data that separates the information region from among the plurality of information regions indicative of respective different cleaner states among the plurality of cleaner states differentiated by different suction pressure values among the suction pressure values and different brush motor load values among the brush motor load values stored in the correlation information, the memory is further configured to store the currently determined suction pressure, the currently determined load of the brush motor, and the currently determined cleaner state as a previously determined suction pressure, a previously determined load of the brush motor, and a previously determined cleaner state, and the at least one processor is configured to determine the plurality of hyperplanes by inputting the previously determined suction pressure and the previously determined load of the brush motor stored in the memory as training data to the SVM.

6. The vacuum cleaner of claim 5, wherein the plurality of hyperplanes are linear kernels.

7. The vacuum cleaner of claim 5, wherein each hyperplane among the plurality of hyperplanes is a hyperplane having a maximum separation distance in the trained data with the suction pressure values and the brush motor load values as attributes.

8. The vacuum cleaner of claim 1, wherein the at least one processor is configured to, when the currently determined cleaner state indicates a lift state in which the brush is separated from a surface to be cleaned and the currently determined suction pressure is equal to or less than a set value, determine a subsequent cleaner state by further considering current rotations per minute (rpm) of the suction motor in addition to the currently determined suction pressure at the suction port and the currently determined load of the brush motor.

9. A method of controlling a vacuum cleaner including a main body, a suction head including a suction port through which debris is sucked up, a brush configured to rotate in the suction head, a brush motor configured to rotate the brush, a suction motor configured to generate suction force so that debris is sucked up through the suction port, a pressure sensor configured to measure atmospheric pressure and pressure at the suction port, a current sensor configured to measure current supplied to the brush motor, at least one processor and a memory, the method comprising:

measuring, by the pressure sensor, atmospheric pressure and pressure at the suction port;

measuring, by the current sensor, a current supplied to the brush motor;

determining a currently determined suction pressure at the suction port based on the atmospheric pressure and the pressure measured by the pressure sensor;

determining a currently determined load of the brush motor based on the current measured by the current sensor;

determining a currently determined cleaner state among a plurality of cleaner states, based on the currently determined suction pressure, the currently determined load of the brush motor and trained data of a support vector machine (SVM) stored in the memory, the trained data includes correlation information in form of suction pressure values stored in correspondence with brush motor load values, such that the correlation information represent a two-dimensional graph of the suction pressure values and the brush motor load values, resulting in the trained data further representing a plurality of information regions determinable by the SVM in the two-dimensional graph, an information region among the plurality of information regions corresponding to a different cleaner state among a plurality of cleaner states based upon the information region corresponding to a region of suction pressure values and a region of brush motor load values among the suction pressure values and the brush motor load values in the correlation information, such that the currently determined cleaner state is determined by identifying an information region among the plurality of information regions to which the currently determined suction pressure and the currently determined load of the brush motor belong, the currently determined cleaner state including at least one of an operation state or a type of surface to be cleaned; and controlling an output of at least one motor among the brush motor and the suction motor based on the currently determined cleaner state.

10. The method of claim 9, wherein the pressure sensor includes a relative pressure sensor including:

a first pressure sensor configured to measure the atmospheric pressure, and a second pressure sensor configured to measure the pressure at the suction port, wherein to determine the currently determined suction pressure at the suction port, the relative pressure sensor is configured to output a difference between the atmospheric pressure measured by the first pressure sensor and the pressure at the suction port measured by the second pressure sensor.

11. The method of claim 9, wherein the pressure sensor includes an absolute pressure sensor configured to measure the pressure at the suction port, and the determining of the currently determined suction pressure includes:

determining the atmospheric pressure based on first output of the pressure sensor before operation of the suction motor, and determining the pressure at the suction port based on second output of the pressure sensor during operation of the suction motor.

12. The method of claim 9, wherein the plurality of information regions are delineated by a plurality of hyperplanes determined by the SVM based on the correlation information, each hyperplane among the plurality of hyperplanes being a boundary information plane in the trained data that separates the information region from among the plurality of information regions indicative of respective different cleaner states among the plurality of cleaner states differentiated by different suction pressure values among the suction pressure values and different brush motor load values among the brush motor load values stored in the correlation information, the method further comprising:

storing, in the memory, the currently determined suction pressure, the currently determined load of the brush motor, and the currently determined cleaner state as a previously determined suction pressure, a previously determined load of the brush motor, and a previously determined cleaner state; and determining, by the at least one processor, the plurality of hyperplanes by inputting the previously determined suction pressure and the previously determined load of the brush motor stored in the memory as training data to the SVM.

* * * * *